US006054043A

United States Patent [19]

Simpson

[11] Patent Number: 6,054,043

[45] Date of Patent: Apr. 25, 2000

[54] PROCESS FOR THE HYDROGENATION OF HYDRO-CARBONACEOUS MATERIALS (CARB-MAT) FOR THE PRODUCTION OF VAPORIZABLE PRODUCTS

[76] Inventor: Theodore B. Simpson, 7120 Georgetown Pike, McLean, Va. 22101

[21] Appl. No.: 08/411,988

[22] Filed: Mar. 28, 1995

[51] Int. Cl.[7] ..... C10G 1/06

[52] U.S. Cl. ..... 208/408; 208/411; 208/419; 208/426

[58] Field of Search ..... 208/408, 426, 208/411, 415, 420, 419; 201/21, 23, 32, 33, 34, 36, 42

[56] References Cited

U.S. PATENT DOCUMENTS

| | | | |
|---|---|---|---|
| 3,001,652 | 9/1961 | Schroeder et al. | 214/17 |
| 3,030,297 | 4/1962 | Schroeder | 208/8 |
| 3,152,063 | 10/1964 | Schroeder et al. | 208/10 |
| 3,762,773 | 10/1973 | Schroeder | 302/53 |
| 3,775,071 | 11/1973 | Hoffert et al. | 48/197 R |
| 3,839,186 | 10/1974 | Berger | 208/8 |
| 3,988,237 | 10/1976 | Davis et al. | 208/8 |
| 4,077,867 | 3/1978 | Aldrige et al. | 208/10 |
| 4,097,361 | 6/1978 | Ashworth | 208/10 |
| 4,169,128 | 9/1979 | Sinor et al. | 422/224 |
| 4,200,494 | 4/1980 | Welter et al. | 208/8 R |
| 4,200,495 | 4/1980 | Liss et al. | 208/8 |
| 4,206,032 | 6/1980 | Friedman et al. | 208/8 R |
| 4,218,287 | 8/1980 | Albright et al. | 208/8 R |
| 4,379,744 | 4/1983 | Rosenthal et al. | 208/10 |
| 4,404,084 | 9/1983 | Huibers et al. | 208/10 |
| 4,437,973 | 3/1984 | Huibers et al. | 208/82 E |
| 4,485,008 | 11/1984 | Maa et al. | 208/10 |
| 4,735,706 | 4/1988 | Ruether | 208/408 |
| 5,015,366 | 5/1991 | Ruether | 208/408 |
| 5,055,181 | 10/1991 | Maa et al. | 208/421 |
| 5,336,395 | 8/1994 | Pabst et al. | 208/403 |
| 5,350,430 | 9/1994 | Coleman et al. | 44/627 |
| 5,648,877 | 7/1997 | Epstein | 48/210 |

*Primary Examiner*—Bekir L. Yildirim

[57] ABSTRACT

A process for the reductive hydrogenation of insufficiently hydrogenated, non-volatile carbonaceous materials to produce vaporizable products wherein the feed materials are brought into initial solution under pressure 300–500° C. with or without the addition of recycle solvent with or without added catalyst. The catalyst may, as an option, be added during agglomeration, if that technique is used, as an oily precursor or as a slurry of a somewhat hydrophobic {namosize} nanosize particulate catalyst or catalyst precursor. Short-contact-time reactors providing plug-type flow and high shear are used. The resultant ashy slurry is passed, highly dispersed, into a fluidized or moving bed of solids that may be inert or catalytic at 350–500° C. and 100–3500 psi where a reducing gas passing up through the bed reductively increases the volatility and decreases the molecular weight of the feed in what is the equivalent of reaction of the feed on each particle in an extremely piston flow manner. As a result, yield loss resulting from coking and gasification of the feed that would be a consequence of too long a reaction time is avoided. The yield improvement is further augmented by the increase in reaction rate that results from the greater area available for transfer of the reducing gas to the film of feed on the particles and from the thinner film through which the reducing gas must diffuse and from the greater catalyst:feed ratio that results from the build-up of catalyst on the particles. A purge of the particulate solids forming the bed passes to a second vessel where its coating may be attrited off the particulate to prepare it for recycle. After or previous to its separation, the coating may be treated to recover energy from its coke content, and catalyst from its ash, all difficult, costly steps in such existing processes as coal liquefaction.

7 Claims, 1 Drawing Sheet

PROCESS FOR THE HYDROGENATION OF HYDRO-CARBONACEOUS MATERIALS (CARB-MAT) FOR THE PRODUCTION OF VAPORIZABLE PRODUCTS

BACKGROUND

The present invention relates generally to a method for the hydrogenation or liquefaction of hydro-carbonaceous materials (Carb-Mat), and more particularly to a method of continuously converting such hydro-carbonaceous materials to volatile hydrocarbon products.

In past continuous processes for the direct liquefaction of hydro-carbonaceous materials, liquids are fed as-is and solids such as coal are ground, preheated, and fed as a slurry to one or more dissolvers, each of which involves a slurry residence time of thirty to sixty minutes, and the ash and insoluble organic matter from the feed in the resulting feed-derived liquid product must be removed. Doing so requires the use of filters, centrifuges, settlers, or other means of solids separation or a combination thereof. Each of these steps involves significant disadvantages. The high-pressure dissolver/reactor vessels must be very voluminous. The solids separation equipment is difficult to operate, bulky, and difficult to make environmentally acceptable. Moreover, the raw product must be fractionated and the resulting yield structure is not ideal. A simplified process is needed to eliminate these disadvantages.

SUMMARY OF THE INVENTION

In accordance with the present invention a simplified process for the liquefaction and conversion to vaporizable products by hydrogenation of Carb-Mat is provided. The process utilizes four sections; in each the residence time is short. In the first section solid Carb-Mat is cleaned. In so doing, it may as an option have been deashed by agglomeration of the finely ground solid Carb-Mat with a small part of the liquid product. In the second section, the Carb-Mat is slurried or otherwise prepared for feeding. In the third section it is quickly heated in the presence of hydrogen or other reducing gas at high pressure (100–3500 psi) at temperature of 650–875° F. with or without a catalyst that has been properly sulfided or catalyst precursor that leads e.g. to a catalyst such as pyrrhotite or MoS2 and is held at temperature for 1–10 minutes. The product of this third section after optional addition of catalyst is sprayed into a fluidized or a moving bed of a solid, that may be inert and is swept with hydrogen or other reducing gas at 650–950° F. One or more such beds in series may be used with the fluid solids cascading from one to the other in series in order to achieve some fractionation by volatility and composition of the product that is taken off as volatile overhead products, essentially free of ash or insoluble (or non-volatile) organic matter (IOM,) along with the spent reducing gas from which they are separated. A purge stream of the solid is taken from the last of these fluid or moving solids beds and fed to a unit where either attrition, gasification, pyrolysis, or combustion or a combination those is used to remove the ash and IOM from the solid so that it can be recycled to the first of these beds. A portion of the liquid product may be recycled to the front end of the process to agglomerate and deash or to slurry a feed Carb-Mat.

Figure 1:
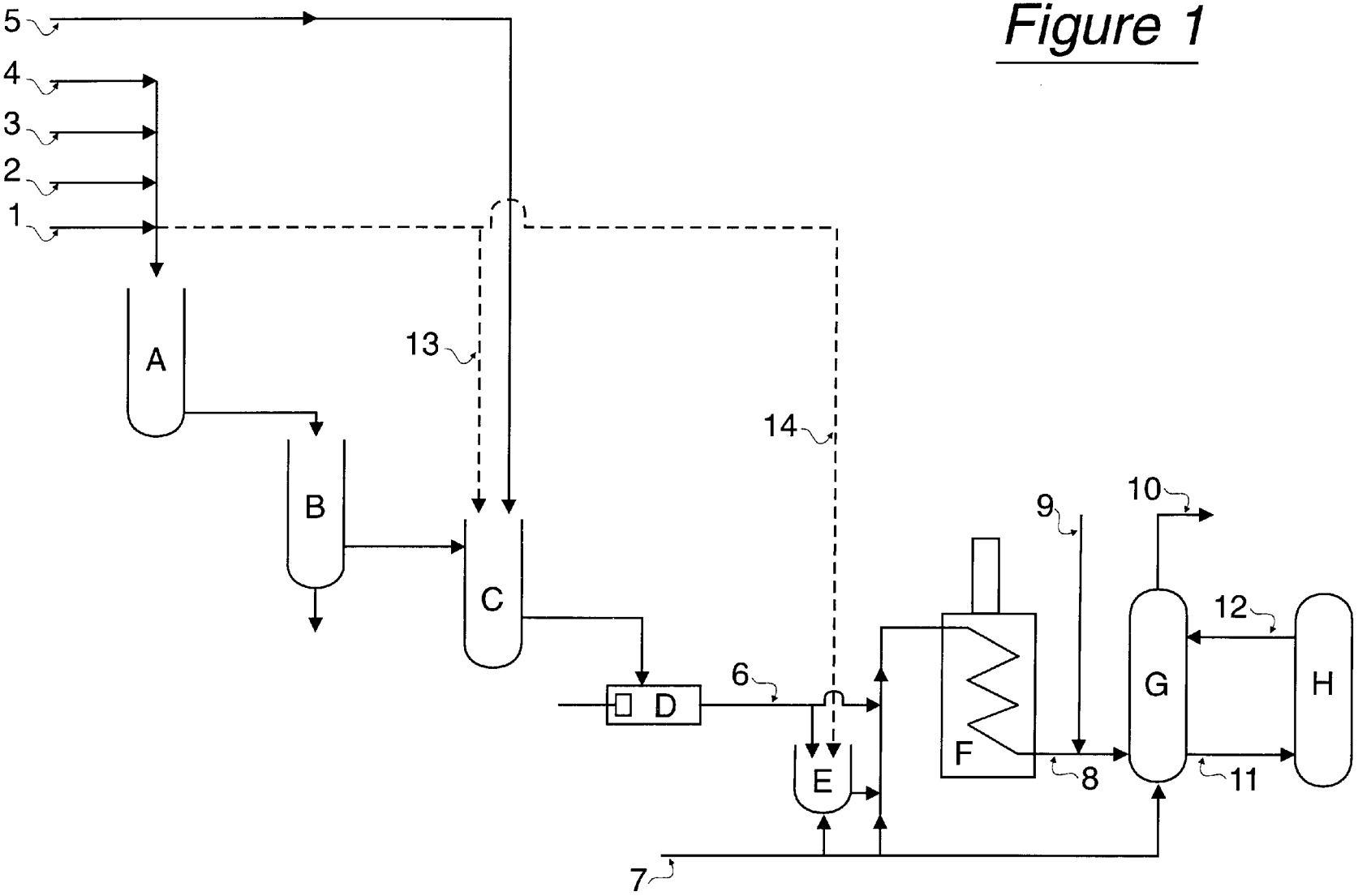
FIG. 1 is a schematic representation of apparatus uitilized for practicing the present invention. The dotted line shows the options for the place in which ground solid Carb-Mat may be fed.

A preferred embodiment of the invention has been chosen for purposes of illustration and description. The preferred embodiment illustrated is not intended to be exhaustive or limit the invention to the precise form disclosed. It is chosen and described in order to best explain the method and principles of the invention and their application in practical use to thereby enable others skilled in the art to best utilize the invention and its various embodiments and modifications as are best adapted to the particular use contemplated.

DETAILED DESCRIPTION

In accordance with the present invention a simplified process for the liquefaction and conversion to vaporizable products by hydrogenation of hydro-carbonaceous materials is provided. The process is comprised of four sections, 1) Solid Carb-Mat cleaning, 2) Solid Carb-Mat feed, 3) Solid or semi solid Carb-Mat dissolution, and 4) conversion to vaporizable products and ash removal. In each of these the residence time is short—significantly shorter than in previous processes.

1) Solid Carb-Mat Cleaning:

In section 1, Solid Carb-Mat Cleaning, there are two options. One is simply conventional cleaning, e.g. as with coal. This might involve jigs heavy media, grinding, floatation, etc; this is shown on FIG. 1 as Stream 1. In the second agglomeration is added. While the first is commonplace, optimization of the use of agglomeration as disclosed herein has resulted in the development of novel interactions with the process of conversion as follows. Referring to FIG. 1, in vessel A, ground feed solid Carb-Mat, Stream 1, is suspended in water (Stream 2) and a suitable process-derived oil such as the 650–850° F. cut or the 650+° F. cut (oil/solid ratio of 0 to 1.0, preferably 0.1 to 0.5 lb oil/lb feed solid,) Stream 4, is added. This slurry is vigorously stirred until the oil has attached itself to the somewhat oleophilic surface of the solid Carb-Mat. Thereupon, the fine solid Carb-Mat particles (minus 8 mesh or less) form small-agglomerates, which are separated, for example, by screening, Vessel B, and the fine dense particles of ash that had been liberated by the grinding of the solid Carb-Mat, pass through the screen, settle, and are separated. Fineness of the solid Carb-Mat not only improves the conversion of the Carb-Mat to product oil and improves its quality, but also increases the degree of liberation of the ash from the solid Carb-Mat and, hence, the degree of deashing.

It is common practice to add a catalyst to improve the liquefaction of the Carb-Mat. Where agglomeration of the solid Carb-Mat is practiced it has been found that there are novel way in which the catalyst can be added with or to this solid. While conventionally the solid has been impregnated with a catalyst by adding a water soluble form of a catalyst precursor (Stream 3) (which, for example, may be converted with a sulfiding agent into such highly active catalysts as compounds of the metals molybdenum, cobalt, nickel, iron, tin, and tungsten such as the pyrrhotite form of iron or the MoS2 form of molybdenum) to the water in the above, I have found this done more effectively by adding an oil soluble compound of the catalytically active metal to the oil or, alternatively, by adding a water or oil suspension of extremely fine particles of catalytic material that have a sufficiently hydrophobic surface to agglomerate along with the solid Carb-Mat.

2) Solid Carb-Mat Feed

There are three alternative forms in which solid Carb-Mat can be fed to carry out the purpose of the second section of the process, namely: 1) dry, 2) pumpable oil slurries or 3) pumpable hot agglomerates. FIG. 1 illustrates the first two of these by the dashed lines leading to Carb-Mat streams 14 and 13 respectively. For the pumpable oil slurries, recycle solvent, Stream 5, obtained from the 650+° F. liquefaction product and the heavier fractions of the liquid product of the process, is slurried at atmospheric pressure with the solid Carb-Mat, Stream 13, or with the agglomerates formed in vessel B, in proportions from about 1:1 to 4:1 recycle solvent/Carb-Mat by weight, preferably 1.3:1 in Vessel C where mixing and some dewatering of the solid Carb-Mat occur at a temperature of about 350° F.

In the third of these feed methods, pumpable hot agglomerates, the agglomerates are made to contain enough oil either when they are prepared or when they are added to Vessel C where they may be heated and fed by pressure differential into positive displacement pump, D, used to meter them into the reactor vessel, E, of the "dissolution" Section of the process. If this or any of the previous type of feed streams passing through pump, D, is fluid enough, Vessel E can be bypassed, and the feed, Stream 6, can be pumped directly into short-contact-time reactor, F.

The first of these three ways to feed the solid Carb-Mat, Stream 14, can use a dry particulate Carb-Mat (stream 1) that can be somewhat coarser. A convenient way to feed such dry relatively fine particles is to force a stream of them out of a slowly fluidized bed of this particulate through a pipe into the reactor vessel, E, by pressure differential.

3.) Solid Carb-Mat Dissolution

The Dissolution step is the first stage of the liquefaction reaction. In the case where the feed stream is high in solids or viscosity as in the case of the plain ground dry solid Carb-Mat (first Feed form, Stream 14) or sometimes the softened agglomerate option, FIG. 1, Stream 6, the feed Stream is dropped into reactor vessel, E, in the bottom of which reducing gas, Stream 7, is sparged. The pressure is 100–3500 psi preferably 2500 and the temperature 350–475° C. Here in a steady state operation a pool of process derived liquid (PDL) is held until it underflows by gravity or is pumped with level control into the next of this series of one or more vessels. The feed of softened agglomerates or particulate feed is directed into this pool of liquid and where it quickly dissolves and reacts with the small amount of hydrogen donated by the solvent used for the preceding agglomeration and with the hydrogen sparge and with hydrogen donors formed from the reaction of the hydrogen with the pool of process-derived liquid. It is desirable to rapidly mix these particles into the pool of liquid and to provide flow shear so that they may be reductively stabilized. In order to do so, a bottom outlet is designed so that swirl mixing occurs, or instead a mixer may be utilized. In the vessels that follow, if any, the temperature may be adjusted to the optimum that is found for the particular feed Carb-Mat. When in this reaction-train the reaction products have reduced the viscosity sufficiently, this slurry is directed to a short contact-time reactor (SCT) (see below), Vessel F. Choice of the SCT rather than a series of partially mixed reactor offers the advantages of greater plug flow and shear mixing. The residence time in Vessels E and F during which the reacting slurry is at temperature (325–500° C.) is 0.5 to 0.8 minutes. so doing avoids, 1) the exposure of a part of the throughput to the excessive reaction times and heat caused by back mixing that would occur in large mixed tanks (both of which result in retrogression to coke and tar), and, 2) the need for excessively high residence times to achieve a high degree of conversion of the portion that does not back mix.

In the case of the oil softened, agglomerated solid Carb-Mat the viscosity may be low enough to feed it directly into the SCT without pluggage problems.

For the case where the feed solid Carb-Mat was prepared by simple mixing of dry solid Carb-Mat with oil, this feed, because of its lower viscosity, is pumped directly into the Short-Contact-Time reactor, F, along with hydrogen or, other reducing gas, Stream 7, where its temperature is increased to 750–900° F., preferably 825° F., with a residence time of 1 to 10 minutes, preferably 2 to 4, at a pressure of 100 to 5000 psi, preferably, 1000–2500 psi. Of this approximately 0.5 to 8 minutes are at the designated temperature. The reactor is preferably a process heater, tubular in nature, in order to achieve a high degree of plug flow with little backmixing of the reactants and to obtain a high degree of shear which also improves conversion to liquids and its product quality. Catalyst may or may not be added here in the soluble or in the so-called slurry form of catalyst wherein extremely fine particles of catalyst or soluble catalyst precursor material, preferably 0 to 300 nm diameter, are suspended in a vehicle, or by having impregnated the feed solid with a solution of the catalyst or its precursor. Such catalysts generally are more effective if they have been presulfided.

Alternatives to the use of the SCT reactor are the conventional ebullated bed or the bubble column reactors. Each of these has the disadvantage of having a high degree of back-mixing. The consequence of this has been outlined above.

4.) Liquefaction+Ash Removal

The fourth section of the process is Liquefaction +Ash Removal. Referring to FIG. 1, the product of Reactor F is fed to vessels G & H. (where the Carb-Mat is sufficiently fluid to disperse, the first three sections of the process are by-passed and the Carb-Mat is fed to Vessel G directly.) Vessel, G, contains either a moving or fluidized bed with a reducing gas Stream, 7, which may contain hydrogen, carbon monoxide, steam, and sulfiding agents such as hydrogen sulfide. Stream 8 from reactor, F, is dispersed either onto or into the fluidized or moving bed of solids or entrained into the feed gas. The quantity or quality of the resultant overhead product is improved as the fineness of dispersion increases. One method of accomplishing this is by ultrasonic atomization of the feed to Vessel G. Catalyst, Stream 9, or its precursor, of the sort described above, may be added to the feed stream before it is injected into Vessel G. Though the feed slurry wets out on the particles of solids in the bed, its feed rate is kept well short of the point at which the bed might bog down. The intimate contact that results between the catalyst-containing process liquid carried by the bed of particulate and the reducing gas results in rapid, complete reaction of the process-derived slurry. A series of such fluid beds with the solids cascading from the one to the other may be used to stage the temperature and to introduce a degree of staging of the reaction where it is needed. The volatile organic product, Stream 10, produced from the Carb-Mat has been reduced in molecular weight and its hydrogen/carbon is increased and heteroatoms (O, N, & S) are largely removed. This product is volatilized and carried off with the fluidizing gas and a largely distillable product is thus obtained. With some Carb-Mats a hydropyrolysis stage in the last of the vessels, G, at a higher temperature (800–950° F.) is desirable which drives off the last of the reactive organic from the fluidized solids.

This hydrogenation reactor achieves highly desirable objectives. These are 1) unusually high mass transfer rates from reducing gas to the liquid on the bed particles because of the high transfer area. 2.) unusually high rate of transfer of reducing gas to catalyst surface because of the thinness of the liquid films through which the gas must be transferred. 3.) unusually intimate contact of the process liquid to the catalyst, 4) build-up of catalyst on the bed particulate, which increases the catalyst:Carb-Mat ratio, 5) immediate removal by volatilization of the lower molecular weight product of hydrogenation of the Carb-Mat, which eliminates the risk of over hydrogenation, 6) true equivalent plug flow reaction of the reactants deposited on each bed particle, and, by integration, of the entire feed to this reactor. 7) fractionation of the product is obtained since the lighter products from the Carb-Mat come off in the first bed. Other advantages come from the remainder of this process section.

The ash, catalyst, and a small amount of unconverted carboniferous matter are left deposited on the solid particles. In order to limit the loading of these deposits on the solids, a purge of these is taken to a regeneration vessel, H, where the insoluble organic matter (IOM) may be burnt off and used to generate process heat or used to produce hydrogen for the process by reaction with oxygen and steam. Alternatively or thereafter, attrition may be used to remove the ashy deposits from the fluidized solids so that they may be recycled, Stream 12, to the vessels, G. The material removed by attrition may be treated for recovery of catalyst (e.g. magnetically in the case of iron) and of IOM to be used as described above. The overhead product from the reactors G, is fractionated and/or separated by flashing in one or more stage(s), and the less volatile portions are used as the Carb-Mat-derived liquid that may be used as recycle solvent at the front end of the process.

The present invention provides several advantages over previously employed techniques for conducting direct liquefaction of Carb-Mat. These advantages include 1) the ability to disperse on the solid Carb-Mat feed a catalyst precursor by addition of an oil soluble form of the catalytic metal to the oil used to agglomerate the feed Carb-Mat or by co-agglomerating fine catalysts or their precursors with the solid Carb-Mat, 2) a technique for feeding the solid Carb-Mat to the first reactor vessel by heating the agglomerates until they are fluid enough to pump, 3) reducing the need for the recycle of process-derived-solvent by using an agglomerate feed with a low solvent:Carb-Mat ratio or a dry solid Carb-Mat feed. This also results in reduced need for reactor volume, 4) further reduction in the reactor volume and the required contact time by the use of Short Contact Time reactors, 5) reducing the occurrence of retrogressive reactions that result in low Carb-Mat conversion and/or a low fraction of hexane soluble oils in the product by increasing the degree of plug flow and reducing back mixing, 6) improvement in yield of liquid product and of hexane-soluble oils, in particular, so that IOM is minimized through the use of short contact time fluidized or moving bed reactor vessels as the final reaction stage, 7) easy removal of the suspended ash and IOM solids for disposal and possible recovery of the catalyst deposited on the inert solids in the fluidized or moving bed reactor vessel, and 8) partial fractionation of the product without added equipment through staging of the last process section. The invention will be further described with reference to the following example.

EXAMPLE 1

Coal was ground and prepared as feed to the first reactor vessel in three ways. One batch is slurried with twice its weight of recycle solvent, made up of the 650°(+)F. fraction from the product of the process and heated to 350° F. as feed to the SCT reactor vessel. A second batch is agglomerated, separated from the unagglomerated ash, dried, and fed to short residence time agitated vessels where heat, dissolution and reaction of coal reduce the viscosity to a level such that the slurry can be fed to a tubular SCT reactor. The third batch is similarly agglomerated, and the agglomerates, prepared with a high oil content, are separated and heated to softness and pumped into a SCT reactor. In the three cases the residence time was 6, 10, and 8 minutes respectively in the first process section; the exit temperature was 825° F.; and the reacting slurry was at that temperature for three minutes. In each case 1500 ppm on coal of iron catalyst (about 10 nm diameter in size when dry) was used as catalyst. The resultant products of this third process section were as follows:

| | Section 3 Feed Method | | | | | |
|---|---|---|---|---|---|---|
| | Wyodak Subbitum Coal | | | Illinois 6 Bitum Coal | | |
| Coal: % MAF | Slurry | Agglom | Hot Agglom | Slurry | Agglom | Hot Agglom |
| C1/C4 GAS | 4 | 5 | 3 | 3 | 4 | 3 |
| Hexane Sol | 63 | 58 | 65 | 35 | 30 | 38 |
| Asphalts | 26 | 28 | 26 | 58 | 61 | 56 |
| IOM | 7 | 9 | 6 | 4 | 5 | 3 |

In the last process section, an added 1000 ppm of the extremely fine iron catalyst was added to each of the products in turn from the previous reactor, and this mixture was sprayed into the bed of silica sand, fluidized by hydrogen gas, in the first of three similar reactors wherein the solids cascaded from the first through to the third, and in the third a purge of the solids was taken that resulted in a total average residence time for the solids of 60 minutes. The unreacted hydrogen carried the resultant volatile products overhead as they were formed. The liquids were collected from each of these overheads and were found to be successively lower in volatility. The pooled overhead product was similar for each of the three feeds having the composition below.

| | |
|---|---|
| C1/C3 | 2% MAF Feed |
| Hexane Soluble | 89% MAF Feed |
| Hexane Insol | 5% MAF Feed |
| IOM | 4% MAF Feed |

MAF = moisture & ash free Coal

A portion of the purged silicious solid from the third fluid bed was for one case attritted in a spouted fluid bed, and the particulate coming overhead was collected. Iron was separated magnetically from it for reuse for catalyst. The attritted silicious solid had little remaining ashy coating and was suitable to reuse in Vessels G.

We claim:

1. In the process for conversion of particulate carbonaceous material into vaporizable products by first deashing the particulate carbonaceous material by making a vigorously stirred slurry of said material in water, adding 0.5 to 35 weight percent of a hydrophobic free flowing organic oil in order to selectively coat and cause agglomeration of said particulate carbonaceous material leaving it free of particles of ash, separating said agglomerate, dewatering and drying said agglomerates, and feeding said agglomerate to a reaction zone for reaction with reducing gas at a temperature of 600–900° F. and a pressure of 100–5000 psi and residence time of one second to three hours to convert it into vaporizable product, the improvement comprising adding the step of mixing an oil-soluble form of liquefaction catalyst or catalyst precursor selected from compounds of the metals, iron, molybdenum, nickel, cobalt, tin and tungsten, into the above hydrophobic free flowing organic oil that is to be added to the water slurry of the particulate carbonaceous material to coat its surface and cause its agglomeration.

2. A process for the conversion by hydrogenation into vaporizable products of carbonaceous material that is not dispersible when heated in the presence of a reducing gas under high pressure at a temperature short of its decomposition temperature, including the steps:

(a) feeding the above carbonaceous material with or without recycle oil, with or without added catalyst into an intensively agitated reaction zone providing the maximum degree of plug flow in the presence of a reducing gas at a temperature of 500–900 degrees F. and pressure of 500–5000 PSI for a residence time of 0–30 minutes that is sufficient to convert it to a dispersible form, (b) dispersing said carbonaceous material in a second reaction zone with or without added catalyst at a temperature of 500–950 degrees F. and pressure of 500–5000 psi onto a moving stream of any dry particulate solid that may itself be a catalytic solid so that the product of the first reaction zone above deposits on the surface of the said dry particulate solid as an extremely thin film, and c) removing a portion of the moving dry particulate solids for regeneration and recycle after recovery of unconverted carbon, catalyst, and ash.

3. The process of claim 2 wherein the reaction of the carbonaceous material deposited on the moving dry particulate solids is separated into a series of two or more reaction zones at temperatures of 600 to 1000 degrees F., pressure of 500 to 5000 psi, and average residence times of one second to twenty-four hours.

4. The process of claim 2 wherein the regeneration of the moving dry particulate solid is accomplished by attrition to remove the ash, catalyst, and unconverted carbonaceous material.

5. A process for conversion by hydrogenation into vaporizable products of carbonaceous material with or without recycle oil that is made dispersible by heating under a reducing gas atmosphere at a pressure of 500–5000 psi and at a temperature short of its decomposition temperature including the steps of:

(a) dispersing said carbonaceous material in a reaction zone with or without added catalyst at a temperature of 500–950 degrees F. and pressure of 500–5000 psi onto a moving stream of any dry particulate solid that itself may be a catalytic solid so that the carbonaceous material deposits on the surface of the dry particulate solid as an extremely thin film without causing it to agglomerate or to bog down or to result in the formation of a slurry or a continuous liquid phase so that the carbonaceous material reacts more rapidly and completely with the stream of reducing gas that also strips the vaporizable product of the reaction of the carbonaceous material rapidly and completely, as it is formed, out of the reaction zone and (b) removing a portion of the moving dry particulate solids for regeneration and recycle after recovery of unconverted carbon, catalyst, and ash.

6. The process of claim 5 wherein the reaction of the carbonaceous material deposited on the moving dry particulate solids is separated into two or more stages at temperatures increasing in the range 600 to 900 degrees F., pressure from 500 to 5000 psi, and average residence times for the particulate solids of one second to twenty-four hours.

7. The process of claim 5 wherein the regeneration of the moving dry particulate solid is accomplished by attrition to remove the ash, catalyst, and unconverted carbonaceous material.

* * * * *